US009395084B2

(12) United States Patent
Bobba et al.

(10) Patent No.: US 9,395,084 B2
(45) Date of Patent: Jul. 19, 2016

(54) FUEL PRE-MIXER WITH PLANAR AND SWIRLER VANES

(75) Inventors: Mohan Krishna Bobba, Simpsonville, SC (US); Abdul Rafey Khan, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 774 days.

(21) Appl. No.: 13/490,061

(22) Filed: Jun. 6, 2012

(65) Prior Publication Data

US 2013/0327046 A1 Dec. 12, 2013

(51) Int. Cl.
*F23D 14/64* (2006.01)
*F23R 3/14* (2006.01)
*F23R 3/28* (2006.01)

(52) U.S. Cl.
CPC . *F23R 3/14* (2013.01); *F23D 14/64* (2013.01); *F23R 3/286* (2013.01); *F23D 2900/14021* (2013.01)

(58) Field of Classification Search
CPC ..... F23D 14/62; F23D 14/64; F23D 2900/14021; F23R 3/14; F23R 3/286; F02C 7/22
USPC ..... 60/737, 740, 748
See application file for complete search history.

(56) References Cited

U.S. PATENT DOCUMENTS 2,755,623 A * 7/1956 Ferri et al. ..... 568/868
3,817,690 A * 6/1974 Bryce ..... F23R 3/18 431/350
4,589,260 A * 5/1986 Krockow ..... 60/737
4,754,600 A * 7/1988 Barbier ..... F23R 3/26 60/39.23
5,193,346 A * 3/1993 Kuwata et al. ..... 60/737
5,218,824 A * 6/1993 Cederwall et al. ..... 60/737
5,259,184 A * 11/1993 Borkowicz et al. ..... 60/39.55
5,408,830 A * 4/1995 Lovett ..... 60/737
5,435,126 A * 7/1995 Beaudoin ..... 60/39.463
5,471,840 A * 12/1995 Lovett ..... 60/737
5,487,274 A * 1/1996 Gulati et al. ..... 60/725
5,491,970 A * 2/1996 Davis et al. ..... 60/776
5,551,228 A * 9/1996 Mick et al. ..... 60/776
5,713,205 A * 2/1998 Sciocchetti et al. ..... 60/740

(Continued)

FOREIGN PATENT DOCUMENTS

CN 103134078 A * 11/2011
EP 2239501 A1 10/2010

OTHER PUBLICATIONS

Unofficial English Translation of Chinese Office Action Issued in connection with corresponding CN Application No. 201310224464.6 on Feb. 25, 2016.

*Primary Examiner* — Phutthiwat Wongwian
*Assistant Examiner* — Eric Linderman
(74) *Attorney, Agent, or Firm* — Dority & Manning, PA

(57) ABSTRACT

A combustor assembly having a fuel pre-mixer including a duct for mixing an airflow and a fuel therein. Also included is a center body coaxially aligned within the duct for receiving the fuel from a fuel source and configured to distribute the fuel to at least one axial location within the duct. Further included is a planar vane section in communication with the airflow and the fuel to provide a first injection of fuel and a flow conditioning effect on the airflow. Yet further included is a swirler vane section disposed downstream of the planar vane section, wherein the swirler vane section is configured to provide a second injection of fuel and a mixing of the fuel and the airflow.

12 Claims, 2 Drawing Sheets

(56) References Cited

U.S. PATENT DOCUMENTS

| | | | | |
|---|---|---|---|---|
| 5,722,230 | A * | 3/1998 | Cohen et al. | 60/39.37 |
| 5,943,866 | A * | 8/1999 | Lovett et al. | 60/737 |
| 6,164,055 | A | 12/2000 | Lovett et al. | |
| 6,438,961 | B2 * | 8/2002 | Tuthill | F23C 7/004 60/737 |
| 6,594,999 | B2 * | 7/2003 | Mandai et al. | 60/722 |
| 6,834,506 | B2 * | 12/2004 | Modi et al. | 60/737 |
| 6,931,854 | B2 * | 8/2005 | Saitoh et al. | 60/737 |
| 7,007,477 | B2 * | 3/2006 | Widener | 60/737 |
| 7,171,813 | B2 * | 2/2007 | Tanaka et al. | 60/737 |
| 7,673,454 | B2 * | 3/2010 | Saito et al. | 60/737 |
| 7,836,698 | B2 | 11/2010 | Vandale et al. | |
| 8,024,932 | B1 * | 9/2011 | Stewart | 60/748 |
| 8,307,660 | B2 * | 11/2012 | Stewart et al. | 60/772 |
| 8,418,469 | B2 * | 4/2013 | Myers et al. | 60/748 |
| 8,607,569 | B2 * | 12/2013 | Helmick et al. | 60/737 |
| 2003/0110774 | A1 * | 6/2003 | Saitoh | 60/737 |
| 2004/0050057 | A1 * | 3/2004 | Bland et al. | 60/737 |
| 2005/0268617 | A1 * | 12/2005 | Amond et al. | 60/776 |
| 2006/0236700 | A1 * | 10/2006 | Saitoh et al. | 60/737 |
| 2008/0148736 | A1 * | 6/2008 | Ishizaka et al. | 60/737 |
| 2009/0173074 | A1 * | 7/2009 | Johnson et al. | 60/737 |
| 2009/0223225 | A1 * | 9/2009 | Kraemer et al. | 60/723 |
| 2010/0077760 | A1 * | 4/2010 | Laster | F23C 7/004 60/742 |
| 2010/0095675 | A1 * | 4/2010 | Lacy | F23R 3/286 60/737 |
| 2010/0101229 | A1 * | 4/2010 | York et al. | 60/737 |
| 2010/0199674 | A1 * | 8/2010 | Widener et al. | 60/737 |
| 2010/0263381 | A1 * | 10/2010 | Ishizaka et al. | 60/737 |
| 2011/0107764 | A1 * | 5/2011 | Bailey et al. | 60/737 |
| 2011/0107769 | A1 * | 5/2011 | Stevenson et al. | 60/772 |
| 2012/0017595 | A1 * | 1/2012 | Liu | F23D 14/02 60/737 |
| 2012/0024985 | A1 * | 2/2012 | Johnson et al. | 239/518 |
| 2012/0297786 | A1 * | 11/2012 | Crawley | F23R 3/02 60/772 |
| 2013/0133329 | A1 * | 5/2013 | Wang | F23R 3/14 60/737 |

* cited by examiner

FUEL PRE-MIXER WITH PLANAR AND SWIRLER VANES

BACKGROUND OF THE INVENTION

The subject matter disclosed herein relates to combustor assemblies for gas turbine systems, and more particularly to fuel pre-mixers for such combustor assemblies.

Exhaust emissions from a combustion process of a gas turbine system are a concern and are subject to mandated limits. Certain types of gas turbine engines are designed for low exhaust emissions operation, and in particular, for low NOx (nitrogen oxides) operation, reduced combustion dynamics, and ample auto-ignition and flameholding margins. Low NOx combustors often include at least one fuel pre-mixer for mixing compressed air and fuel as they pass through the at least one fuel pre-mixer. Efficient mixing of the compressed air and fuel includes, in part, conditioning the flow in a manner to promote a homogenous air-fuel mix before transfer to a combustion chamber. Such efficient mixing should be achieved without compromising overall efficiency of the gas turbine system.

BRIEF DESCRIPTION OF THE INVENTION

According to one aspect of the invention, a combustor assembly having a fuel pre-mixer including a duct for mixing an airflow and a fuel therein. Also included is a center body coaxially aligned within the duct for receiving the fuel from a fuel source and configured to distribute the fuel to at least one axial location within the duct. Further included is a planar vane section in communication with the airflow and the fuel to provide a first injection of fuel and a flow conditioning effect on the airflow. Yet further included is a swirler vane section disposed downstream of the planar vane section, wherein the swirler vane section is configured to provide a second injection of fuel and a mixing of the fuel and the airflow.

According to another aspect of the invention, a combustor assembly having a fuel pre-mixer including a duct having a first end for receiving an airflow from a compressor disposed upstream of the combustor assembly, wherein the airflow is transferred through the duct along a longitudinal direction of the duct. Also included is a center body disposed within and along the longitudinal direction of the duct and configured to receive a fuel from at least one fuel manifold proximate the first end of the duct. Further included is a planar vane section comprising a plurality of relatively planar vanes circumferentially spaced from each other and disposed in the longitudinal direction of the duct and at a first axial location within the duct, wherein the planar vane section is in communication with the airflow and the fuel. Yet further included is a swirler vane section comprising a plurality of swirler vanes circumferentially spaced from each other and disposed at a second axial location within the duct, wherein the second axial location is downstream of the first axial location.

According to yet another aspect of the invention, a gas turbine system includes a compressor for providing an airflow. Also included is a fuel pre-mixer. The fuel pre-mixer includes a duct for receiving the airflow, wherein the airflow is transferred through the duct in a first direction. The fuel pre-mixer also includes a first vane section comprising a plurality of relatively planar vanes circumferentially spaced from each other and extending radially between a center body and an inner wall of the duct, wherein each of the plurality of relatively planar vanes is aligned in the first direction. The fuel pre-mixer further includes a second vane section comprising a plurality of swirler vanes circumferentially spaced from each other and extending radially between the center body and the inner wall of the duct, wherein at least a portion of each of the plurality of swirler vanes is disposed at an angle to the first direction.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
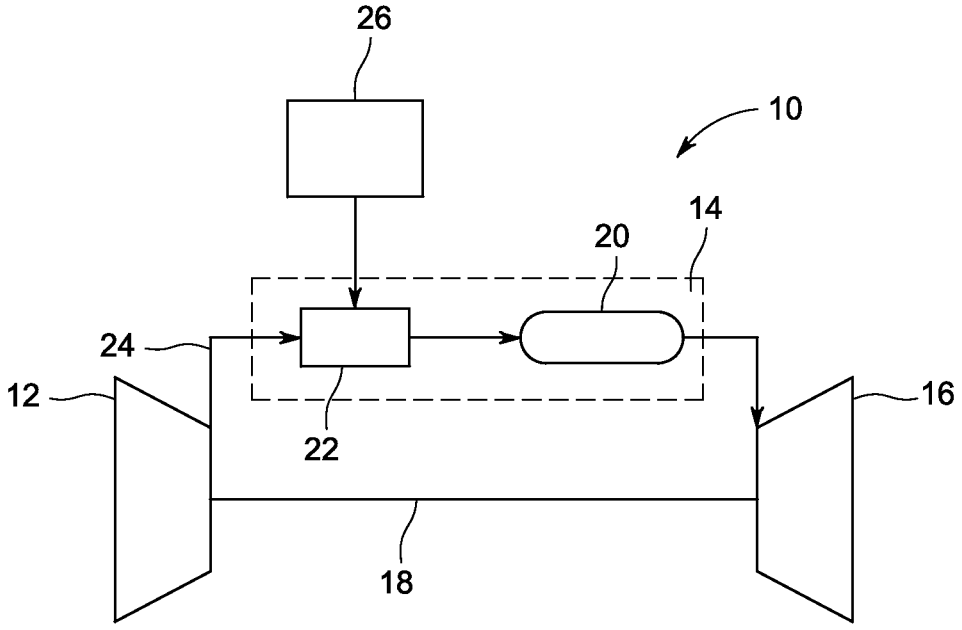
FIG. 1 is a schematic illustration of a gas turbine system having a combustor assembly.

Referring to FIG. 1, a gas turbine system is schematically illustrated with reference numeral 10. The gas turbine system 10 includes a compressor 12, a combustor assembly 14, a turbine 16, and a shaft 18. It is to be appreciated that one embodiment of the gas turbine system 10 may include a plurality of compressors 12, combustor assemblies 14, turbines 16 and/or shafts 18. The compressor 12 and the turbine 16 are coupled by the shaft 18. The shaft 18 may be a single shaft or a plurality of shaft segments coupled together to form the shaft 18.

The combustor assembly 14 uses a combustible liquid and/or gas fuel, such as a natural gas or a hydrogen rich synthetic gas, to run the gas turbine system 10. The combustor assembly 14 includes a combustor chamber 20 that is in fluid communication with a fuel pre-mixer 22 that is in fluid communication with an airflow 24 and a fuel source 26. The fuel pre-mixer 22 creates an air-fuel mixture, and discharges the air-fuel mixture into the combustor chamber 20, thereby causing a combustion that creates a hot pressurized exhaust gas. The combustor chamber 20 directs the hot pressurized gas through a transition piece into the turbine 16, causing rotation of the turbine 16. Rotation of the turbine 16 causes the shaft 18 to rotate, thereby compressing air as it flows into the compressor 12.

Figure 2:
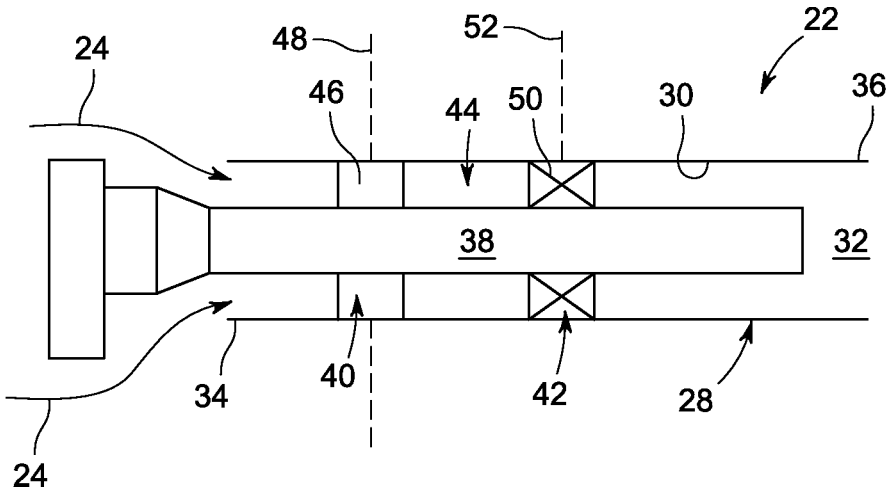
FIG. 2 is a side, elevational schematic illustration of a fuel pre-mixer of the combustor assembly.

Referring now to FIG. 2, the fuel pre-mixer 22 receives the airflow 24, which may be compressed air from the compressor 12, as well as a fuel from the fuel source 26, such as a fuel manifold. The fuel pre-mixer 22 comprises a duct 28 having an inner wall 30 that defines an interior region 32. The duct 28 includes a first end 34 configured to receive the airflow 24, and a second end 36 for transferring the air-fuel mix to the combustor chamber 20 for combustion therein. The duct 28 is typically tubular in geometry, but it is to be appreciated that the duct 28 may be of various geometric cross-sectional configurations.

The fuel pre-mixer 22 also includes a center body 38 disposed coaxially within the duct 28. The center body 38 is in fluid communication with the fuel source 26 and receives fuel proximate the first end 34 of the duct 28. The center body 38 extends through the duct 28, and more specifically is connected to and extends through a first vane section 40 and a second vane section 42, from proximate the first end 34 of the duct 28 to the second end 36 of the duct 28. The center body 38 is disposed radially inward of the inner wall 30 of the duct 28 to define a flow path 44 therebetween.

The first vane section 40 comprises a plurality of relatively planar vanes 46 that are operably connected to, and extend radially away from, the center body 38. It is to be appreciated that the number of relatively planar vanes may vary based on the application. The plurality of relatively planar vanes 46 are disposed at a first axial location 48 within the duct 28 and extend toward, and may connect to, the inner wall 30 of the duct 28. Each of the plurality of relatively planar vanes 46 are circumferentially spaced from each other at the first axial location 48 and are configured to receive fuel from the center body 38. Each of the plurality of relatively planar vanes 46 include a plurality of apertures (not illustrated) for selectively distributing the fuel to various circumferential and radial locations of the flow path 44 at the first axial location 48. The plurality of relatively planar vanes 46 are aligned such that the airflow 24 passing therethrough experience a low resistance based on the planar portion of the plurality of relatively planar vanes 46 being disposed in a longitudinal direction of the duct 28 (i.e., at an angle of 0° with the predominant direction of the airflow 24). The alignment of the plurality of relatively planar vanes 46 results in a flow conditioning effect, namely a straightening of the flow to provide a clean, uniform flow profile as the airflow 24 passes through the first vane section 40. Fuel is mixed with the airflow 24 within the first vane section 40, as fuel is ejected through the plurality of apertures located on the plurality of relatively planar vanes 46.

The second vane section 42 comprises a plurality of swirler vanes 50 that are operably connected to, and extend radially away from, the center body 38. It is to be appreciated that the number of swirler vanes may vary depending on the application. The plurality of swirler vanes 50 are disposed at a second axial location 52 within the duct 28 and extend toward, and may connect to, the inner wall 30 of the duct 28. The second axial location 52 is downstream of the first axial location 48 and it is to be appreciated that the actual axial spacing between the first axial location 48 and the second axial location 52 may vary based on the application. Each of the plurality of swirler vanes 50 are circumferentially spaced from each other at the second axial location 52 and are configured to receive fuel from the center body 38. Similar to the plurality of relatively planar vanes 46, each of the plurality of swirler vanes 50 include a plurality of apertures for selectively distributing the fuel to various circumferential and radial locations of the flow path 44 at the second axial location 52 The plurality of swirler vanes 50 are aligned such that swirling of the airflow 24, or an air-fuel mixture in the case where fuel is introduced upstream of the second vane section 42, is achieved to further enhance mixing of the airflow 24 and any fuel introduced to the flow path 44. The alignment of the plurality of swirler vanes 50 results in an impact on the flow, namely a swirling of the flow to promote mixing, as described above. This may be achieved by orienting the entire portion of the plurality of swirler vanes 50 at any number of angles to the direction of the flow. Alternatively, or in combination with disposing the entire portion of the plurality of swirler vanes 50 at an angle, only a portion of the plurality of swirler vanes 50 may be disposed at an angle to the direction of flow. In such a configuration, the plurality of swirler vanes 50 may include a relatively planar portion 54 aligned in the longitudinal direction of the duct 28 (i.e., at an angle of 0° to the direction of flow) and a downstream portion 56 disposed at an angle, for example, and illustrated in FIGS. 3 and 4. Within the second vane section 42, fuel is mixed with the airflow 24, or the air-fuel mixture where fuel has already been introduced upstream of the second vane section 42. Similar to the first vane section 40, fuel is expelled through the plurality of apertures located on the plurality of swirler vanes 50.

The distribution ratio of fuel to the flow path 44 for mixing with the airflow 24 through the first vane section 40 and/or the second vane section 42 may be controlled. In this way, the respective percentages of the fuel introduced to the flow path 44 through the first vane section 40 and the second vane section 42 may be altered to efficiently mix with the airflow 24. For example, 50% of the fuel may be distributed to the flow path 44 through each of the first vane section 40 and the second vane section 42. It is to be appreciated that this ratio may vary from either extreme of 0%-100% for both the first vane section 40 and the second vane section 42. The fuel distribution ratio may be fixed or actively controlled. In the case of active control, one or more controllers are employed to provide the ability to actively alter the distribution ratio during operation of the fuel pre-mixer 22. Furthermore, it is contemplated that additional vane sections may be employed to distribute the fuel and/or impart an effect on the flow characteristics.

Figure 3:
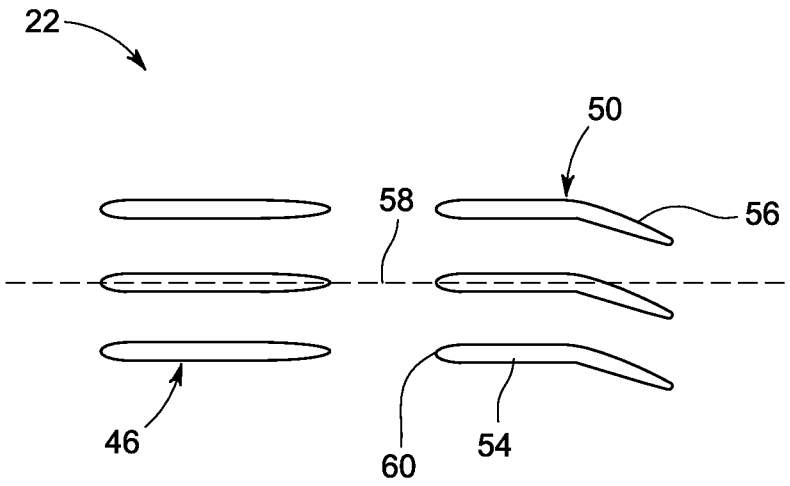
FIG. 3 is a schematic illustration of a first vane section and section vane section arrangement of a first embodiment.

Referring now to FIG. 3, a first embodiment of the fuel pre-mixer 22 is illustrated. In the exemplary embodiment, the alignment of the plurality of relatively planar vanes 46 with respect to the plurality of swirler vanes 50 is described as an "in-line" alignment. Each of the plurality of relatively planar vanes 46 include an "in-line" plane 58 extending in the longitudinal direction of the duct 28. Each of the plurality of swirler vanes 50 include a leading edge 60 disposed at an upstream location of the plurality of swirler vanes 50. In the illustrated embodiment, the leading edge 60 of each of the plurality of swirler vanes 50 is aligned with the in-line plane 58 of the plurality of relatively planar vanes 46.

Figure 4:
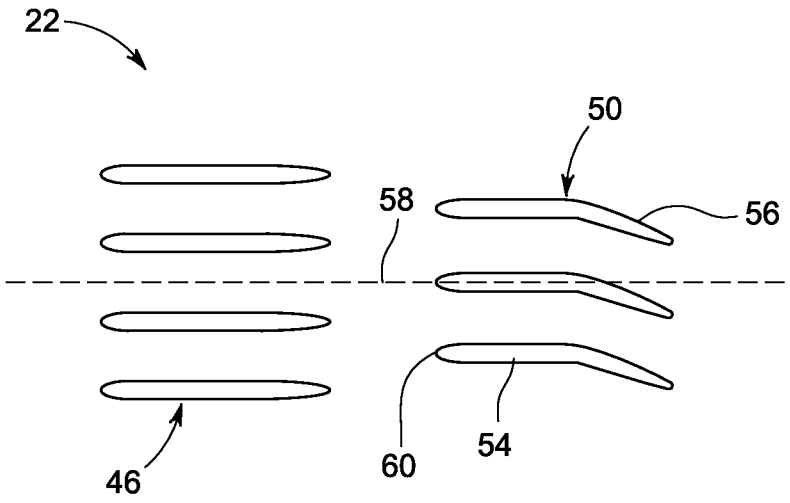
FIG. 4 is a schematic illustration of the first vane section and the second vane section arrangement of a second embodiment.

Referring now to FIG. 4, a second embodiment of the fuel pre-mixer 22 is illustrated. In the exemplary embodiment, the alignment of the plurality of relatively planar vanes 46 with respect to the plurality of swirler vanes 50 is described as a staggered alignment. In the illustrated embodiment, the leading edge 60 of each of the plurality of swirler vanes 50 is aligned at an offset to the in-line plane 58 of the plurality of relatively planar vanes 46. The staggered alignment provides an enhanced fuel distribution pattern.

Accordingly, spreading fuel injection over multiple sections of vanes inherently stages fuel distribution and assists in mixing of fuel with the airflow 24. Such an arrangement improves flame holding and NOx emission performance, based on a "cleaner" flow field interaction with fuel injection locations upstream of swirling of the fuel-air mixture.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor assembly having a fuel pre-mixer comprising:

a duct for mixing an airflow and a fuel therein;

a center body coaxially aligned within the duct for receiving the fuel from a fuel source and configured to distribute the fuel to at least one axial location within the duct;

a planar vane section in communication with the airflow and the fuel source to provide a first injection of fuel and a flow conditioning effect on the airflow, the planar vane section comprising a plurality of relatively planar vanes, each planar vane having a leading edge axially spaced from a trailing edge, wherein the leading edge and the trailing edge of each planar vane are axially aligned, wherein the plurality of planar vanes is circumferentially spaced around the centerbody, each of the plurality of relatively planar vanes having a planar portion aligned in a longitudinal direction of the duct to straighten the airflow and each two circumferentially adjacent planar vanes form an airflow channel therebetween; and a swirler vane section disposed downstream of the planar vane section, the swirler vane section comprising a plurality of circumferentially spaced swirler vanes, each of the plurality of swirler vanes having a leading edge positioned downstream from corresponding trailing edge of the two circumferentially adjacent planar vanes of the plurality of plurality of planar vanes, wherein the leading edge of each swirler vane is circumferentially offset from the two circumferentially adjacent planar vanes of the plurality of planar vanes, thereby forming a staggered formation between the planar vane section and the swirler vane section, wherein the swirler vane section is configured to provide a second injection of fuel and a mixing of the fuel and the airflow.

2. The combustor assembly of claim 1, wherein each of the plurality of relatively planar vanes is operably connected to, and extends radially outward from, the center body, wherein the fuel is distributed through the plurality of relatively planar vanes and ejected at a plurality of radial locations to a flow path of the duct for mixing with the airflow.

3. The combustor assembly of claim 1, wherein at least a portion of each of the plurality of swirler vanes is disposed at an angle to a longitudinal direction of the duct.

4. The combustor assembly of claim 3, wherein each of the plurality of swirler vanes is operably connected to, and extends radially outward from, the center body, wherein the fuel is distributed through the plurality of swirler vanes and ejected at a plurality of radial locations to a flow path of the duct for mixing with the airflow.

5. The combustor assembly of claim 1, wherein the airflow is received from a compressor, wherein the fuel source is a fuel manifold.

6. The combustor assembly of claim 1, wherein the fuel is distributed to a flow path of the duct through the planar vane section and the swirler vane section, wherein a first fraction of the fuel is distributed through the planar vane section and a remaining fraction of the fuel is distributed through the swirler vane section.

7. A combustor having a fuel pre-mixer comprising:

a duct having a first end for receiving an airflow from a compressor disposed upstream of the combustor assembly, wherein the airflow is transferred through the duct along a longitudinal direction of the duct;

A center body disposed within and along the longitudinal direction of the duct and configured to receive a fuel from at least one fuel manifold proximate the first end of the duct;

a planar vane section comprising a plurality of relatively planar vanes circumferentially spaced from each other, wherein each planar vane of the plurality of relatively planar vanes includes a leading edge axially spaced from a trailing edge and aligned in the longitudinal direction of the duct to straighten the airflow, the plurality of relatively planar vanes disposed at a first axial location within the duct, wherein the planar vane section is in communication with the airflow and the fuel source and each two circumferentially adjacent planar vanes form an airflow channel therebetween; and a swirler vane section comprising a plurality of swirler vanes circumferentially spaced from each other and disposed at a second axial location within the duct, each of the plurality of swirler vanes having a leading edge positioned downstream from corresponding trailing edges of the two circumferentially adjacent planar vanes of the plurality of planar vanes, wherein the leading edge of each swirler vane is circumferentially offset from the two circumferentially adjacent planar vanes of the plurality of planar vanes, thereby forming a staggered formation between the planar vane section and the swirler vane section, wherein the second axial location is downstream of the first axial location.

8. The combustor assembly of claim 7, wherein each of the plurality of relatively planar vanes is operably connected to, and extends radially outward from, the center body, wherein the fuel is distributed through the plurality of relatively planar vanes and ejected at a plurality of radial locations to a flow path of the duct for mixing with the airflow.

9. The combustor assembly of claim 7, wherein at least a portion of each of the plurality of swirler vanes is disposed at an angle to the longitudinal direction of the duct wherein each of the plurality of swirler vanes is operably connected to, and extends radially outward from, the center body, wherein the fuel is distributed through the plurality of relatively planar vanes and ejected at a plurality of radial locations to a flow path of the duct for mixing with the airflow.

10. A gas turbine system comprising;

a compressor for providing an airflow; and a fuel pre-mixer comprising:

a duct for receiving the airflow, wherein the airflow is transferred through the duct in a first direction and mixed with a fuel;

a first vane section comprising a plurality of relatively planar vanes circumferentially spaced from each other and extending radially between a center body and an inner wall of the duct, wherein each planar vane of the plurality of relatively planar vanes includes a leading edge axially spaced from a trailing edge and aligned in a longitudinal direction of the duct to straighten the airflow and each two circumferentially adjacent planar vanes form an airflow channel there between; and a second vane section comprising a plurality of swirler vanes circumferentially spaced from each other and extending radially between the center body and the inner wall of the duct, each of the plurality of swirler vanes having a leading edge positioned downstream from corresponding trailing edges of the two circumferentially adjacent planar vanes of the plurality of planar vanes, wherein the leading edge of each swirler vane is circumferentially offset from the two circumferentially adjacent planar vanes of the plurality of planar vanes, thereby forming a staggered formation between the planar vane section and the swirler vane section, wherein at least a portion of each of the plurality of swirler vanes is posed at an angle to the first direction.

11. The gas turbine system of claim 10, wherein the fuel is distributed to a flow path of the duct through the first vane section and the second vane section, wherein a first fraction of the fuel is distributed through the first vane section and a remaining fraction of the fuel is distributed through the second vane section.

12. The gas turbine system of claim 10, wherein the swirler vane leading edge of the plurality of swirler vanes is offset from an in-line plane of the plurality of relatively planar vanes.

* * * * *